US007022091B2

(12) United States Patent
Chen

(10) Patent No.: US 7,022,091 B2
(45) Date of Patent: Apr. 4, 2006

(54) TRANSMISSION ASSEMBLY FOR A MASSAGING CHAIR

(76) Inventor: Peter Chen, Room 4C-23, No. 5, Sec. 5, Sinyi Rd., Taipei (TW)

( * ) Notice: Subject to any disclaimer, the term of this patent is extended or adjusted under 35 U.S.C. 154(b) by 0 days.

(21) Appl. No.: 10/930,063

(22) Filed: Aug. 30, 2004

(65) Prior Publication Data

US 2006/0047235 A1 Mar. 2, 2006

(51) Int. Cl.
*A61H 19/00* (2006.01)

(52) U.S. Cl. ..... 601/98; 601/99; 601/100

(58) Field of Classification Search ..... 601/33, 601/36, 57, 58, 97–99, 100
See application file for complete search history.

(56) References Cited

U.S. PATENT DOCUMENTS 5,179,940 A * 1/1993 Barreiro ..... 601/99
5,233,973 A * 8/1993 Gill et al. ..... 601/103
6,551,259 B1 * 4/2003 Wu ..... 601/99

* cited by examiner

*Primary Examiner*—Michael A. Brown
(74) *Attorney, Agent, or Firm*—Dellett & Walters

(57) ABSTRACT

A transmission assembly for a massaging chair includes an integral transmission casing with a longitudinal passage and two latitudinal passages to respectively receive therein a longitudinal shaft, a chopping shaft and a rubbing shaft so that minimal noise is created during operation of the transmission assembly.

2 Claims, 4 Drawing Sheets

TRANSMISSION ASSEMBLY FOR A MASSAGING CHAIR

BACKGROUND OF THE INVENTION

1. Field of the Invention

The present invention relates to a transmission assembly, and more particularly to a transmission assembly for a massaging chair to greatly improve the operational smoothness and reduce operation noise.

2. Description of Related Art

A massaging chair is able to provide different kinds of massaging effect to the user according to the user's choice, which includes chopping, kneading and rubbing motions. In order to accommodate users' requirements based on the aching portions in the body, the massaging chair is provided with a frame mounted inside a backrest to receive therein a transmission casing which in turn is used to accommodate therein a latitudinal shaft, a longitudinal shaft and transmission gears.

In view of the existing massaging chair, the transmission casing is commonly composed of two symmetrical portions such that only after the two portions are assembled, can the transmission elements be installed inside the space between the two portions. Although modern technology enables the manufacturers to produce fine parts so that when the parts are assembled, the clearance between two assembled portions is minimized, after a long period of time repeating the mechanical operation inside the transmission casing in the conventional transmission assembly, the clearance is enlarged, which is the cause of mechanical wear, metal fatigue and above all, noise. Imagine that if a user is trying to relax on the massaging chair, and a screeching noise is constantly or intermittently generated by two adjacent parts, how can the user achieve the desired relaxation?

To overcome the shortcomings, the present invention tends to provide an improved transmission assembly to mitigate the aforementioned problems.

SUMMARY OF THE INVENTION

The primary objective of the present invention is to provide an improved transmission assembly having an integral transmission casing to dramatically reduce the noise otherwise generated by movement of parts.

Other objects, advantages and novel features of the invention will become more apparent from the following detailed description when taken in conjunction with the accompanying drawings.

DETAILED DESCRIPTION OF THE PREFERRED EMBODIMENT

Figure 1:
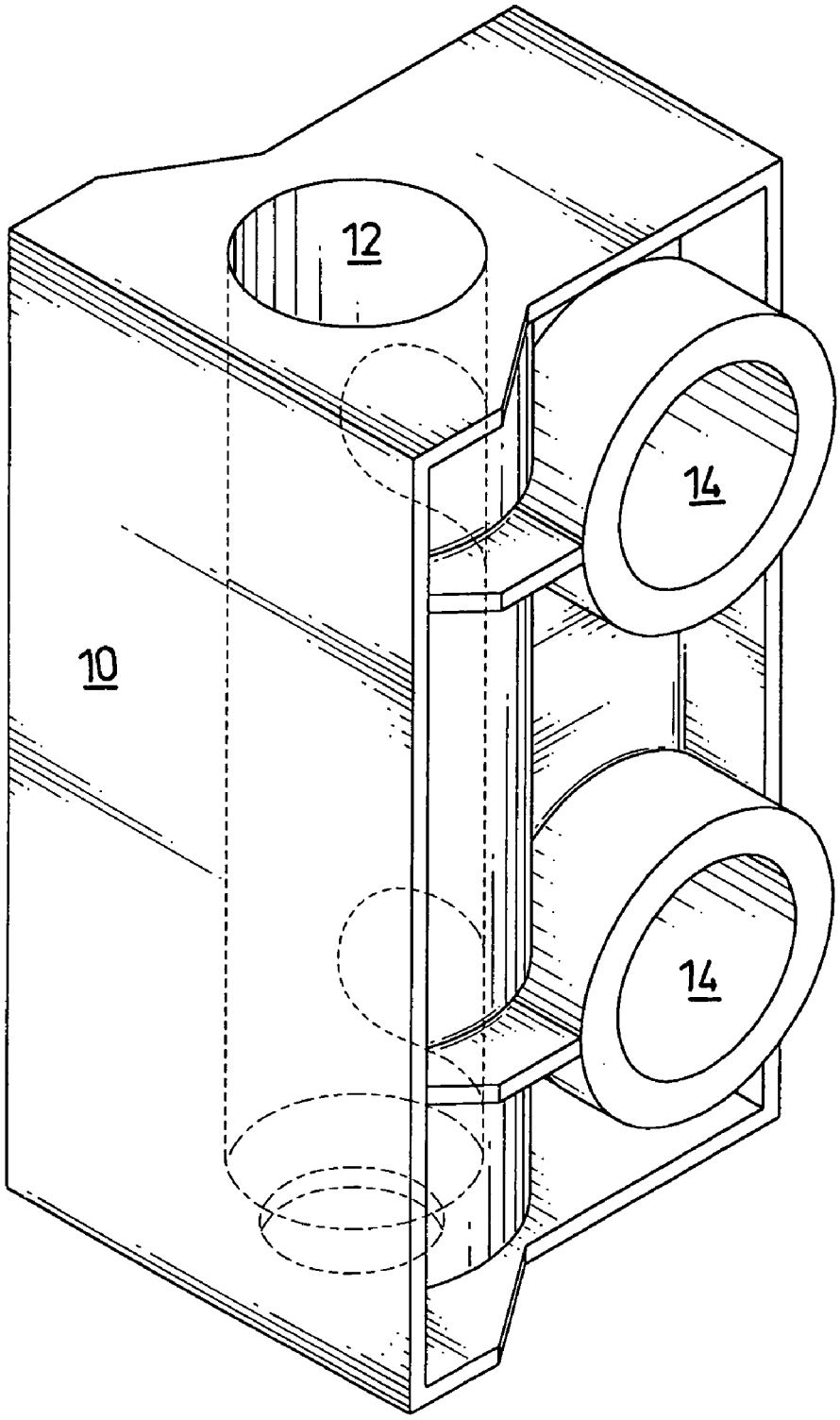
FIG. 1 is a perspective view of the transmission casing of the present invention.

With reference to FIG. 1, the transmission casing (10) in accordance with the present invention includes a longitudinal passage (12) and two latitudinal passages (14) respectively in communication with the longitudinal passage (12).

Figure 2:
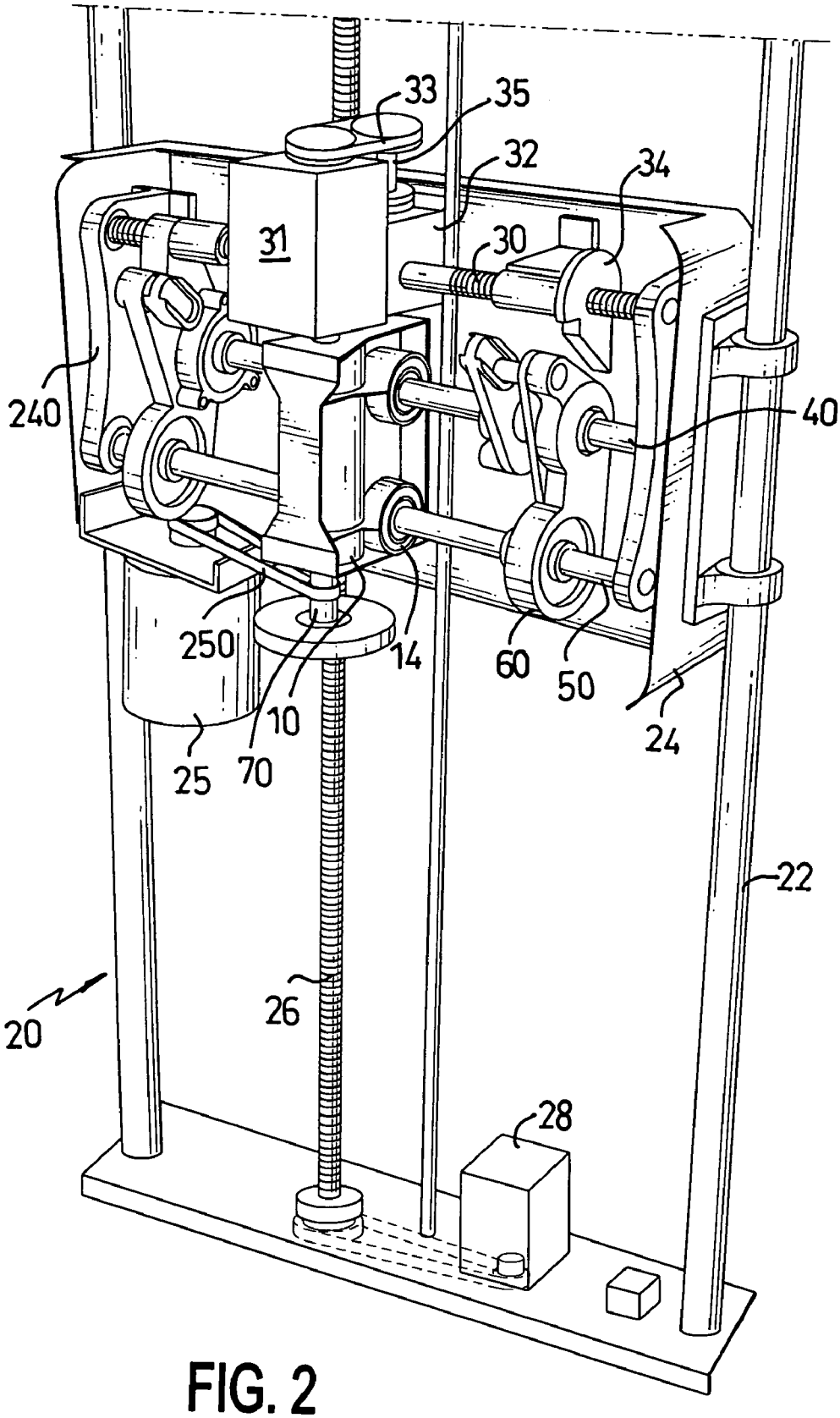
FIG. 2 is a perspective view showing the transmission assembly inside the transmission casing which is not shown in this drawing.

With reference to FIG. 2, it is noted that the massaging chair is provided with a frame (20), two guiding tracks (22) respectively mounted on opposed sides of the frame (20), an assembly board (24) securely mounted between the two guiding tracks (22) to accommodate therein parts of the transmission assembly, a threaded axle (26) perpendicularly mounted in the frame (20) to be parallel to the two guiding tracks (22) and a first motor (28) mounted on the frame (20) to drive the threaded axle (26) to rotate in either of two directions.

An inner board (240) is respectively mounted on opposed sides of the assembly board (24) for pivotal connection to latitudinal shafts such as a width adjustment device (30), a chopping shaft (40) and a rubbing shaft (50) in this preferred embodiment, wherein the width adjustment device (30) is extended between the two inner boards (240) while extending through an assembly seat (32) and provided with a driving plate (34) on an opposed portion of the width adjustment device (30), the chopping shaft (40) and the rubbing shaft (50) are respectively extended through the two latitudinal passages (14) in the transmission casing (10). Furthermore, after extending through the two latitudinal passages (14) in the transmission casing (10), the chopping shaft (40) and the rubbing shaft (50) are respectively extended through a massaging device (60).

A second motor (25) is also provided to a bottom portion of the assembly board (24) to drive a longitudinal shaft (70) via a belt (250). The longitudinal shaft (70) is extended through the longitudinal passage (12) in the transmission casing (10).

Figure 3:
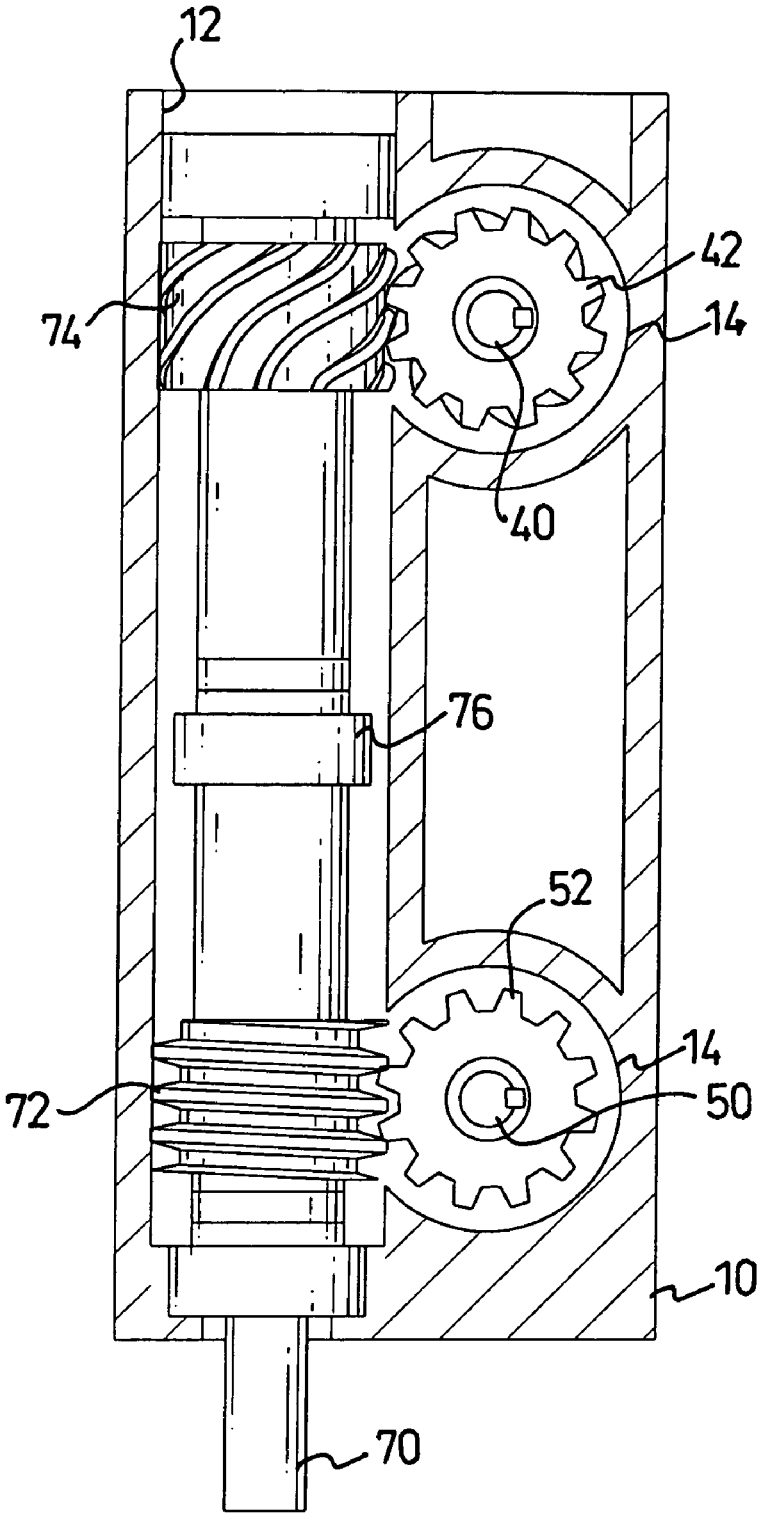
FIG. 3 is a schematic cross sectional view showing the interrelationship among the longitudinal shaft, the chopping shaft and the rubbing shaft.

With reference to FIG. 3, the longitudinal shaft (70) is provided with a worm shaft (72) to mate with a worm gear (52) mounted on the rubbing shaft (50) and a slanted gear (74) to mate with a gear (42) mounted on the chopping shaft (40), wherein a unidirectional bearing (76) is provided between the worm shaft (72) and the slanted gear (74) to allow the portions where the worm shaft (72) and the slanted gear (74) are mounted to rotate differently or simultaneously with respect to each other. That is, for example, when the longitudinal shaft (70) is rotated in a first direction by the driving force from the second motor (25) via the belt (250), the longitudinal shaft (70) can only drive the worm shaft (72) to rotate in the same direction as that of the longitudinal shaft (70) such that the worm gear (52) is rotated simultaneously and thus the rubbing shaft (50) is rotated; however, when the longitudinal shaft (70) is rotated in the second direction, both the worm shaft (72) and the slanted gear (74) are rotated simultaneously. Thus the worm gear (52) and the gear (42) are rotated and consequently the user is able to use the transmission assembly of the present invention to receive massaging effect via the massaging device (60).

Figure 4:
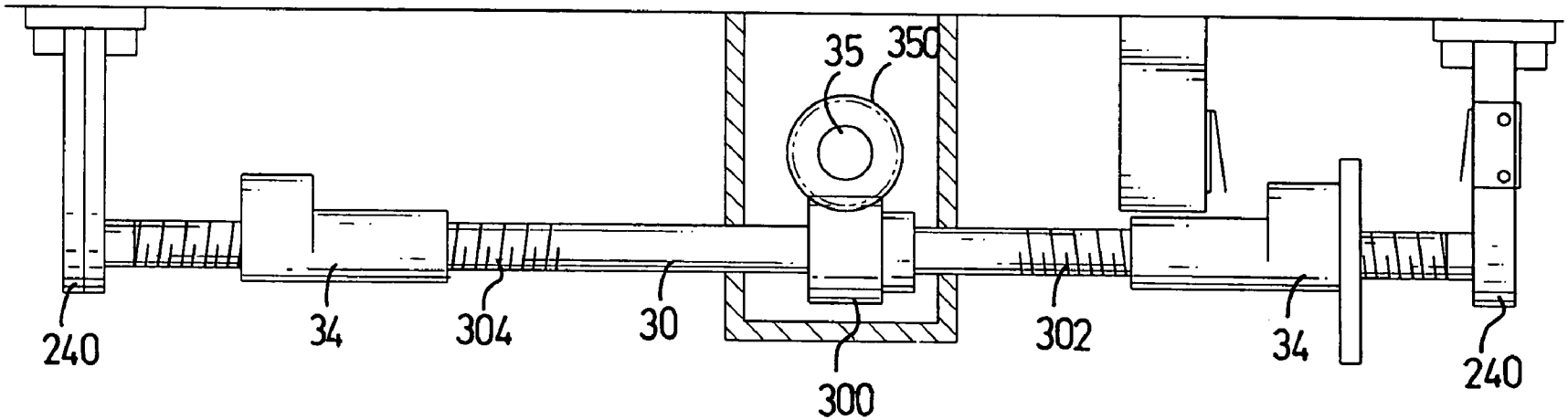
FIG. 4 is a schematic view showing the allocation of the width adjustment device of the present invention.

With reference to FIG. 4 and still taking FIG. 2 for reference, it is noted that the width adjustment device (30) includes a third motor (31), a transmission belt (33) and a driven axle (35).

The width adjustment device (30) is extended through the assembly seat (32) and the driven axle (35) is provided with a second worm shaft (350) to drive a second worm gear (300) which is mounted on the width adjustment shaft (30).

The width adjustment shaft (30) is provided with, on opposed sides thereof, a driving plate (34), a first thread (302) and a second thread (304). The driving plates (34) are provided with appropriate threads to correspond to the first thread (302) and the second thread (304) respectively such that when the width adjustment shaft (30) is rotated via the third motor (31), simultaneous movement of the two driving plates (34) toward or away from each other along the first thread (302) and the second thread (304) respectively are able to drive the massaging device (60) to accomplish width adjustment requirement.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. In a massaging chair having a frame with two guiding tracks mounted respectively on opposite sides of the frame;

an assembly board securely mounted between the two guiding tracks to accommodate therein a transmission assembly, wherein the transmission assembly comprises an integral transmission casing having a longitudinal passage and two latitudinal passages in communication with the longitudinal passage;

a first motor mounted on a bottom portion of the assembly board;

a threaded axle extending through the assembly board to be driven by the first motor;

an inner board provided on opposite sides of the assembly board to pivotally connect to a first latitudinal shaft, a second latitudinal shaft and a third latitudinal shaft;

the first latitudinal shaft extending through an assembly seat and having two driving plates provided on opposite sides of the first latitudinal shaft;

the second latitudinal shaft and the third latitudinal shaft extending through the latitudinal passage in the transmission casing to connect to an assembly device that is driven by the driving plates on the first latitudinal shaft; and a longitudinal shaft extending through the longitudinal passage in the transmission casing to be driven by a second motor and provided with a worm shaft to mate with a worm gear on the second latitudinal shaft and a slanted gear to mate with a gear on the third latitudinal shaft so that when the longitudinal shaft is rotated by the second motor, the second longitudinal shaft and the third latitudinal shaft are rotated; and a unidirectional bearing provided between the worm shaft and the slanted gear to allow the second latitudinal shaft and the third latitudinal shaft to either rotate simultaneously or differently with respect to each other.

2. The massaging chair as claimed in claim 1, wherein the first latitudinal shaft extends through the assembly seat and has two driving plates mounted respectively on opposite sides of the first latitudinal shaft to be in contact with a massaging device, a first thread and a second thread having an orientation different from that of the first thread, each driving plate is respectively and threadingly connected to the first thread and second thread so that the driving plates are able to move toward or away from each other when the first latitudinal shaft is rotated by a third motor and thus the massaging device is adjusted by the two driving plates.

* * * * *